US006494823B2

(12) United States Patent
Vuorimies et al.

(10) Patent No.: US 6,494,823 B2
(45) **Date of Patent: *Dec. 17, 2002**

(54) TAKE-OUT ROLL, SPREADER ROLL, OR EQUIVALENT FOR A WEB-LIKE MATERIAL

(75) Inventors: Timo Vuorimies, Järvenpää (FI); Pekka Koivukunnas, Järvenpää (FI)

(73) Assignee: Metso Paper, Inc., Helsinki (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 56 days.

(21) Appl. No.: 09/155,272

(22) PCT Filed: Jan. 27, 1998

(86) PCT No.: PCT/FI98/00078

§ 371 (c)(1),
(2), (4) Date: Sep. 24, 1998

(87) PCT Pub. No.: WO98/33734

PCT Pub. Date: Aug. 6, 1998

(65) Prior Publication Data

US 2001/0008863 A1 Jul. 19, 2001

(30) Foreign Application Priority Data

Jan. 30, 1997 (FI) ..... 970379

(51) Int. Cl.[7] ..... B23P 15/00
(52) U.S. Cl. ..... 492/16; 492/20; 492/45
(58) Field of Search ..... 492/16, 20, 45; 26/101, 102, 103, 104; 198/824, 826

(56) References Cited

U.S. PATENT DOCUMENTS

| | | | | |
|---|---|---|---|---|
| 3,001,682 A | | 9/1961 | Carroll et al. | 226/192 |
| 4,146,947 A | | 4/1979 | Richter | 26/104 |
| 4,692,971 A | * | 9/1987 | Ginter | 26/103 |
| 4,748,909 A | | 6/1988 | Theilacker | 101/226 |
| 4,787,504 A | * | 11/1988 | Schultz | 198/782 |
| 5,882,697 A | * | 3/1999 | Joensuu | 226/194 |

FOREIGN PATENT DOCUMENTS

| | | | |
|---|---|---|---|
| CA | 766843 | 9/1987 | 26/11 |
| CA | 2146391 | 10/1995 | B65H/57/00 |
| CH | 619998 | 10/1980 | D06C/3/06 |
| DE | 2110079 | 9/1972 | D06C/3/06 |
| DE | 3311095 | 10/1984 | B65H/23/02 |
| EP | 0225988 | 8/1987 | B65H/23/34 |
| EP | 0679596 | 11/1995 | B65H/27/00 |
| FI | 951921 | 4/1995 | |

* cited by examiner

*Primary Examiner*—I. Cuda-Rosenbaum
(74) *Attorney, Agent, or Firm*—Steinberg & Raskin, P.C.

(57) ABSTRACT

A take-out roll, spreader roll or equivalent roll for a web-like material having three parts linked with one another, namely, a middle part and two end parts, one on each side of the middle part. The middle part and end parts are pivotal with respect to one another for the purpose of bending the roll into a desired curved shape. The middle part is constructed to operate as a revolving axle of the roll which is mounted revolvingly on support members by end bearings. The end parts are mounted in the area of their axial inner ends on the middle part by articulation devices. The end parts are further mounted in the area of their axial outer ends, revolvingly and movably in a radial direction on support parts which are separated from the revolving parts of the roll by bearings arranged inward of the end bearings in the axial direction of the roll.

14 Claims, 3 Drawing Sheets

TAKE-OUT ROLL, SPREADER ROLL, OR EQUIVALENT FOR A WEB-LIKE MATERIAL

FIELD OF THE INVENTION

The invention relates to a take-out roll, spreader roll, or equivalent for a web-like material, which roll comprises three parts linked with one another, i.e. two end parts and a middle part, which parts are pivotal with respect to one another for the purpose of bending the roll into a desired curved shape.

BACKGROUND OF THE INVENTION

Take-out rolls and spreader rolls have been formed most commonly so that they have a continuous axle and a roll mantle fitted on the axle, which roll mantle is in turn composed of a number of parts. The take-out roll can be made to be curved into a desired shape by shifting the outer journalling points of the roll mantle in the radial direction, whereby the mantle forms an arc or a broken line. Each of the mantle parts is generally journalled separately on the axle, in which case the arrangement comprises a number of bearings. The conventional arrangements involve a number of problems and drawbacks, which are, among other things, problems of journalling of the roll and peaks of heat produced by the journalling in the paper web. The making of the mantle of several parts may also constitute a considerable problem because the gaps between the parts may mark the paper web and because the arc form of the roll is not optimal, but the line of shape of the roll is shaped as a broken line. Further, owing to the metallic roll mantle, problems of corrosion may arise. One such prior-art spreader roll is described, for example, in the U.S. Pat. No. 4,692,971. Attempts have been made to provide an improvement over such a prior-art spreader roll, for example, so that a coating layer of a resilient material has been fitted onto the metal mantle consisting of a number of parts, the objective of this arrangement being in particular to provide an improvement concerning the problem of marking of the paper web and concerning optimization of the arc form of the roll. However, the journalling system of the roll is similar to that described above, and, thus, also the problems related to the journalling are unchanged. Such a spreader roll is described, for example, in the Canadian Patent No. 766,843.

Previously, attempts have been made to find a solution to the problem arising from a roll mantle made up of several parts also so that, as the roll mantle, a continuous metal tube mantle has been used which has been provided with "cuts", i.e. into which slots have been formed in order to facilitate the bending of the roll mantle. This construction, however, causes its own problems, one worth noticing being the fact that, owing to its construction, the roll mantle becomes quite slack, i.e. excessively readily bending. In such a case, the roll mantle concerned must be supported on the roll axle by means of bearings at a number of points, for which reason the problems described above and arising from the journalling remain unchanged. Also, the cost of manufacture of the roll mantle is relatively high because of the mode of manufacture.

The greatest problems of present take-out rolls, spreader rolls and equivalent are mainly due to the construction of the roll in use, which is most commonly a construction of the kind in which the roll comprises a non-revolving roll axle and a roll mantle revolvingly journalled on it. In addition to the prior art publications already cited previously, reference is made in this connection to the Finnish Patent Application No. 951921, which fairly representatively describes the prevailing prior art. More specifically, said publication describes a roll comprising a continuous and non-revolving roll axle. A roll mantle made up of three parts, i.e. a middle part and end parts, is fitted on the axle. The middle part is journalled in the area of its both ends directly on the axle of the roll. The inner ends of the end parts are also journalled directly on the axle and the outer ends are similarly journalled on separate sleeve parts, whose inside diameter is larger than the diameter of the axle. The sleeve parts can be shifted radially, whereby the roll mantle curves or, more exactly, attains the shape of a broken line, when the outer ends of the end parts of the mantle move radially with respect to the inner ends. The roll is thus provided with a desired "curved" shape.

However, all the arrangements of today involve the drawback that there are journalling points in the inner area of the roll mantle, that is, in the area of the web. Firstly, arrangement of lubrication of these bearings is at least principally difficult to provide. A second, even more serious drawback is that the bearings heat up during operation with the result that this heating up produces a thermal gradient in paper. Heat is transferred with the paper into a roll nip and, at worst, it may cause burning of a soft nip roll. In the FI Application 951921, for example, attempts have been made to solve this problem in such a way that thermal insulation material is provided in connection with the bearings situated in the area of the web for the purpose of reducing the transfer of heat from the bearings to the paper web. The structure of the roll has, however, become very complicated and expensive, and yet it has not been possible to eliminate all drawbacks.

OBJECTS AND SUMMARY OF THE INVENTION

The object of the present invention is to provide a novel construction of a take-out roll, spreader roll, or equivalent, by means of which the problems related to the prior art described above are avoided. With a view to achieving the objective of the invention, the invention is mainly characterized in that the middle part of the roll is constructed to also operate as a revolving axle of the roll, which is mounted revolvingly on its support members by means of end bearings, and that the end parts of the roll are mounted, in the area of their axial inner ends, on the middle part by means of articulation devices.

The invention provides quite a considerable advantage over the prior art, and of the advantages obtainable by means of the invention, for example, the following may be mentioned. The roll does not comprise across the width of the web any lubrication points that impede the use of the roll and make its use more difficult. Also, there has been no need to place any bearings in the roll in the area of the width of the web, thereby making it possible to avoid the problems of the prior art caused by heating up of bearings. Considerably smaller bearings may be used in the roll as compared with conventional take-out rolls, bearing frictions being then also smaller than previously. The number of bearings has been made smaller than previously, since the roll needs only four roller bearings, whereas the rolls in accordance with the prior art usually comprised at least six roller bearings and two glide bearings. The axle of the roll is substantially more rigid than in the previous arrangements, which employ a separate non-revolving axle. A possible drive is very easy to arrange by coupling a drive means simply to the end of the roll axle. Owing to the construction in accordance with the invention, for example, a composite material may be used as the roll material. In that case, the roll is advantageously constructed as a shell structure, whereby the roll becomes fairly light in weight and its lowest specific frequencies can be raised so high that the support provided by the end journalling of the roll is sufficient for support of the entire roll. The further advantages and characteristic features of the invention come out from the following detailed description of the invention.

BRIEF DESCRIPTION OF THE DRAWINGS

In the following, the invention will be described by way of example with reference to the figures in the accompanying drawing.

DETAILED DESCRIPTION OF THE PREFERRED EMBODIMENTS

Figure 1:
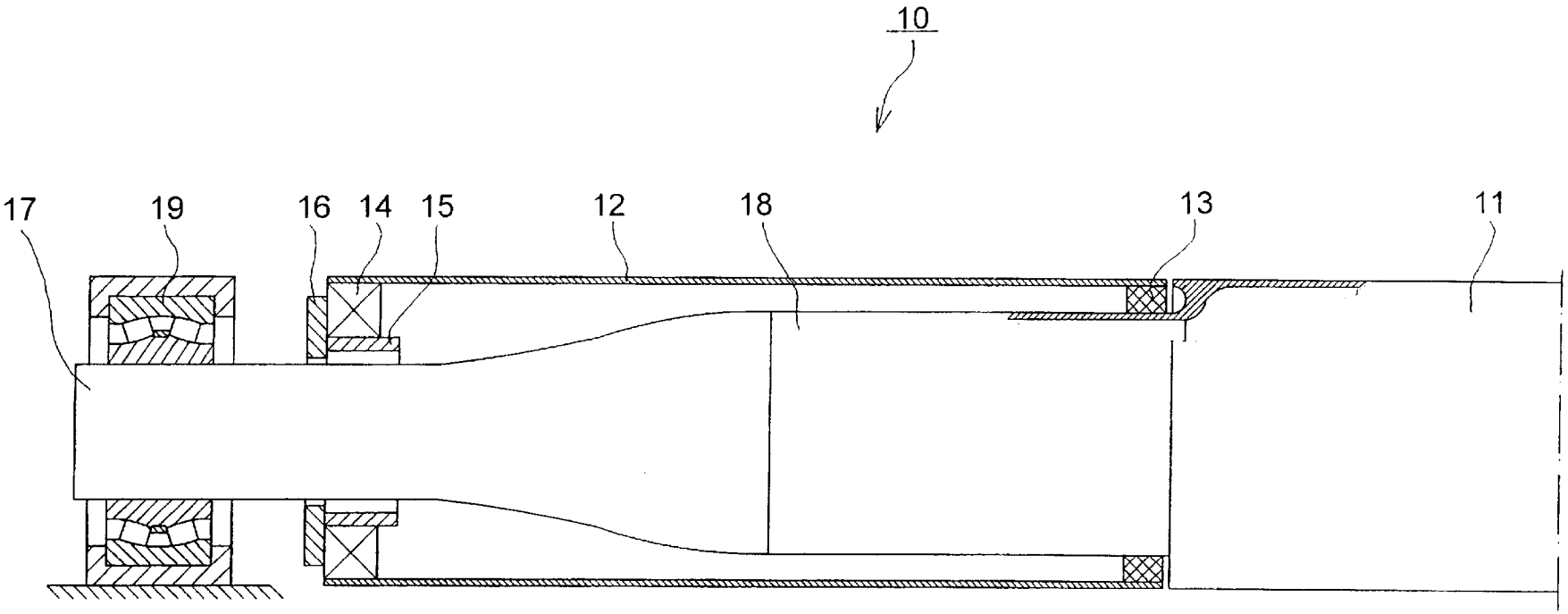
FIG. 1 is a schematic partial sectional view of one end area of a roll in accordance with the invention.

FIG. 1, then, shows one end area of a roll in accordance with the invention and, in said figure, the roll is generally denoted with the reference numeral 10. The other end of the roll 10 is similar. The roll 10 comprises a middle part 11, of which only a small part is seen in the figure, and end parts 12. The roll 10 does not include separately an axle and a mantle rotating on it, but, instead, the middle part 11 also serves as a roll axle which is mounted by means of end bearings 19 on its support members. The end bearings 19 are preferably roller bearings, as shown in FIG. 1 of the drawing. In order that the end bearings 19 might be made suitable in size, that is, sufficiently small, an extension 17 of the middle part 11 functioning as an axle is substantially smaller in diameter than the middle part 11, corresponding in size to the conventional diameter of a non-revolving axle.

The end parts 12 of the roll are tubular parts, and they are mounted directly on the middle part 11 such that articulation devices 13 are fitted at the inner end of the end parts 12 inside the tubular end parts 12, which articulation devices in the illustration of FIG. 1 are, for example, flexible rubber sleeves or equivalent. Said articulation devices 13 are fitted to the bending or deflection point of the roll 10, and they are supported so as to rest on the middle part 11. FIG. 1 of the drawing shows that between the middle part 11 and its extension 17 there is an intermediate part 18, which is in diameter smaller than the middle part 11 and larger than its extension 17. The articulation devices 13 are disposed specifically on these intermediate parts 18. The intermediate parts 18 having a smaller diameter than the middle part 11 are needed in order that the outer diameter of the tubular end part 12 may be made the same as that of the middle part 11 of the roll. The structure may also be accomplished such that there is no separately identifiable intermediate part 18 and no extension 17, but, instead, the middle part 11 changes in shape smoothly into an extension 17, from which the roll is journalled by means of the end bearings 19. In the axial direction in the area of their outer ends, the tubular end parts 12 are carried on bearings, for example, on roller bearings 14 mounted on support parts 15 which are separate from the revolving parts of the roll. The support parts comprise sleeve-like parts which are in inside diameter larger than the extension of the middle part so that the position of the bearings 14 may be radially shifted and adjusted. In FIG. 1, attempts are made to illustrate this schematically by means of a regulating device denoted with the reference numeral 16. By adjusting the position of the bearings 14 of the tubular end parts 12 it is possible to regulate both the amount of curvature and the direction of curvature of the roll 10.

In summary of the structure illustrated in FIG. 1 it may be further stated that in the roll 10 in accordance with the invention there are no parts revolving with respect to one another, but, instead, the roll 10 is mounted as a whole revolvingly at its ends by means of the bearings 19. Thus, no bearings at all are needed inside the roll 10 in the area of the width of the web, but, instead, at the deflection point of the roll, i.e. at the point where the end parts of the roll are pivotal with respect to the middle part, there are arranged only the articulation devices 13, which, at their simplest, are rubber sleeves or equivalent as shown in FIG. 1.

Figure 2:
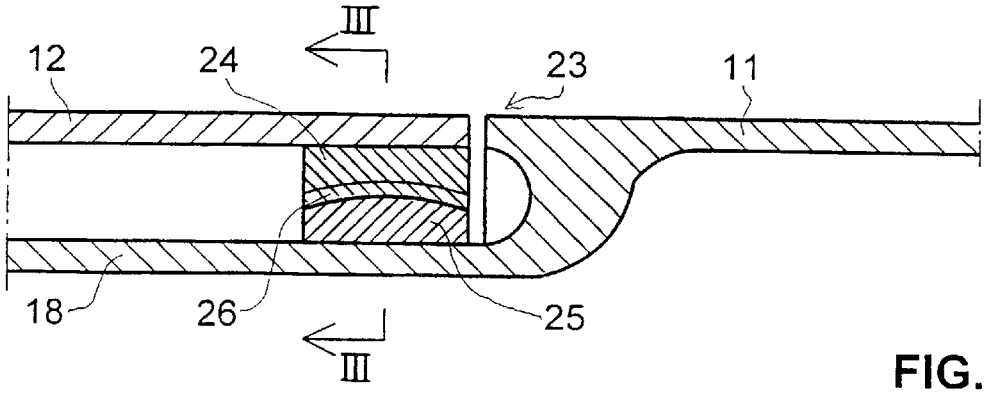
FIG. 2 shows, on a larger scale, an alternative embodiment of a joint between an end part and a middle part of the roll shown in FIG. 1.
Figure 3:
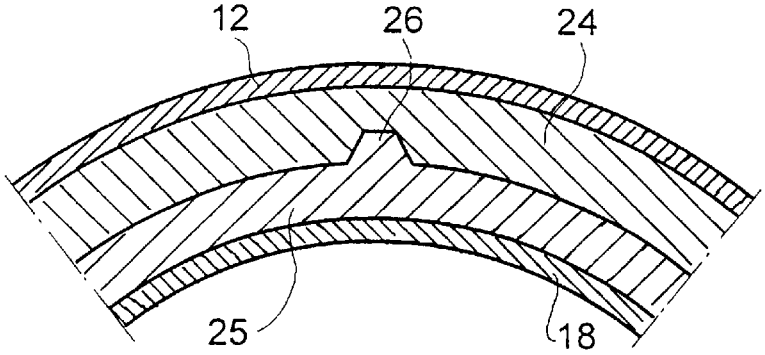
FIG. 3 is a schematic sectional view along the line III—III from FIG. 2.

FIGS. 2 and 3 show an alternative embodiment of the articulation device illustrated in FIG. 1. In said FIGS. 2 and 3, the articulation device is generally denoted with the reference numeral 23. In this embodiment, the articulation device 23 is a structure of the articulation bearing type which comprises an outer ring 24 fitted to the end part 12 of the roll and an inner ring 25 fitted onto the intermediate part. Said outer ring 24 and inner ring 25 are constructed such that the tangential friction between them is sufficiently high so that the outer ring 24 is not able to rotate with respect to the inner ring 25. At its simplest, this is arranged in such a way that, for example, the inner ring 25 is provided with at least one tooth 26 and, similarly, the outer ring 24 is provided with a corresponding groove, into which said tooth 26 fits. In that case, the articulation device 23 operates in the fashion of a constant velocity universal joint.

Figure 4:
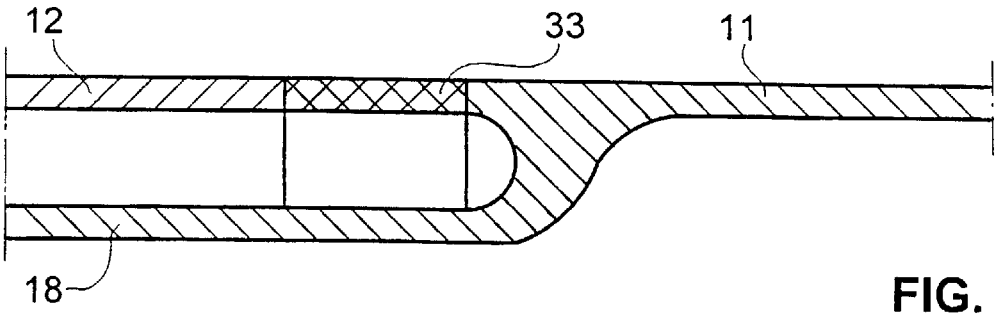
FIG. 4 is a further alternative embodiment of a joint between the end part and the middle of the roll as an illustration corresponding to FIG. 2.

FIG. 4 additionally shows an alternative arrangement for an articulation device which in FIG. 4 is denoted with the reference numeral 33. In the embodiment illustrated in this figure, the articulation device 33 constitutes a structural part of the roll itself. This kind of arrangement is easy to provide, for example, in rolls made of a composite material in which the middle part 11 and the end part 12 of the roll are linked to each other by means of the articulation device 33, which is of the same material both with the middle part 11 and with the end part 12, but which is substantially more flexible and more elastic than these. In that case, the outer face of the roll is totally continuous without any gaps between the middle part 11 and the end part 12.

Figure 5:
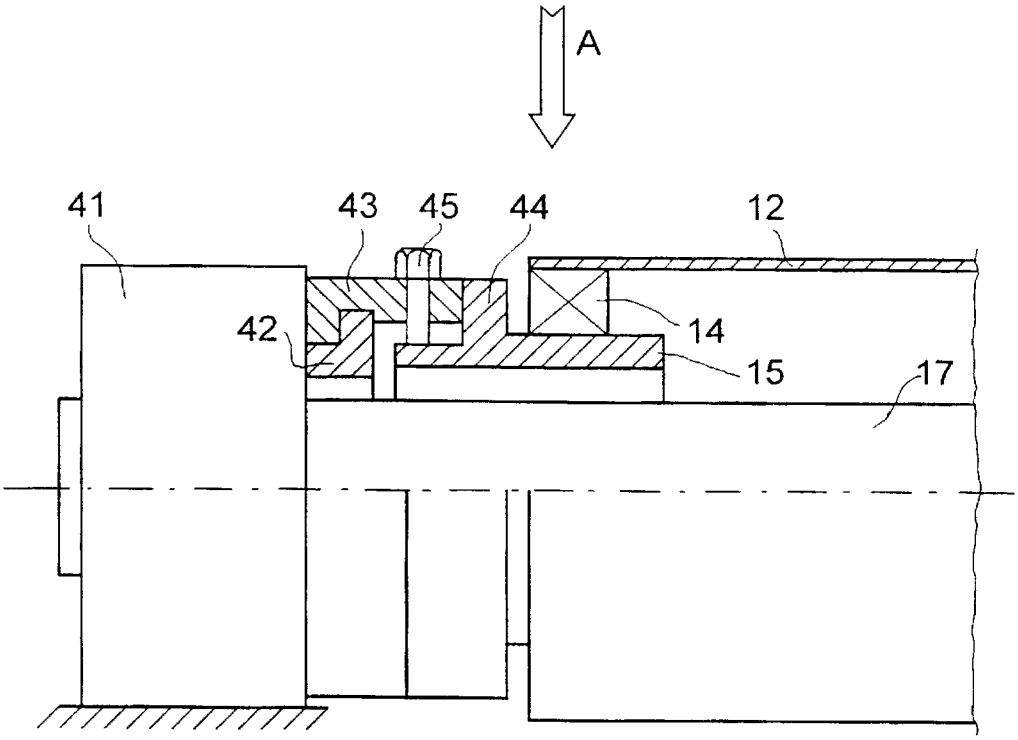
FIG. 5 fully schematically shows the principle of a mechanism of regulating the curvature of the roll in a partial sectional view.
Figure 6:
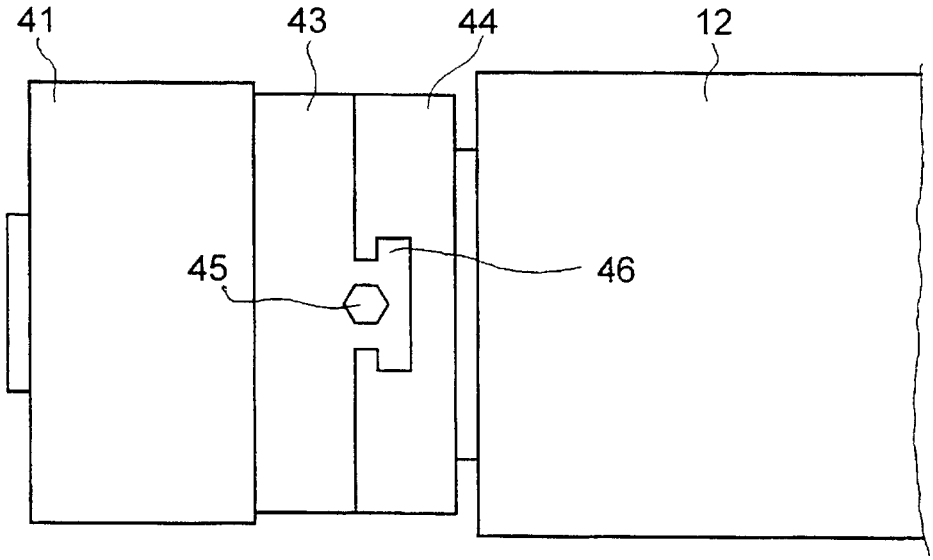
FIG. 6 shows the structure illustrated in FIG. 5 seen in the direction of an arrow A.

As was already previously briefly mentioned, for example, in the description relating to FIG. 1, both the amount of curvature and the direction of curvature of the roll in question can be regulated in a desired manner. In FIGS. 5 and 6 of the drawing, attempts are made to illustrate this principle of the regulating mechanism. In said figures, the reference numeral 41 denotes a bearing housing, which contains, for example, the end bearing 19 of the roll shown in FIG. 1. For the curvature regulating device, a fixed internal bearing part 42 is fixedly mounted and secured to the bearing housing 41 or to some equivalent separate support structure (not shown) that is stationary in its mounting. A frame part 43 of the curvature regulating device is fitted on support of this fixed internal bearing part 42, which frame part thus operates as an external bearing part. Necessary bearing members (not shown) are fitted between the fixed internal bearing part 42 and the frame part 43 of the curvature regulating device, said bearing members enabling a rotational movement of the frame part 43 on the fixed internal bearing part 42. Thus, the frame part 43 is able to perform only a rotational movement with respect to the internal bearing part 42 around the centre axis of the roll, but no other movement. A support part 44 which includes a sleeve-like part 15 and on which the bearing 14 of the tubular end part 12 of the roll is fitted is in turn mounted to the frame part 43 in such a way that the support part 44 can perform a linear movement with respect to the frame part 43 in a radial direction of the roll. This linear movement is made possible such that guides have been machined to the frame part 43 and, similarly, counter-guides fitting these guides have been machined to the support part 44. The guides and counter-guides are illustrated in FIG. 6 by the reference numeral 46. The regulating member accomplishing adjustment of the curvature of the roll is illustrated in FIGS. 5 and 6 by means of a regulating screw 45.

By means of the arrangement shown in FIGS. 5 and 6, the curvature of the roll is adjusted so that the support part 44 is moved by means of the regulating member 45 in a radial direction of the roll with respect to the frame part 43. The direction of curvature is in turn adjusted so that the frame part 43 is rotated on the fixed internal bearing part 42. Furthermore, as already previously stated, FIGS. 5 and 6 show the curvature regulating device fully schematically, and, thus, the figures do not show at all by what kind of members the frame part 43 can be rotated on the fixed internal bearing part 42. However, these members can be embodied in several different ways. The screw representing the regulating member 45 may also be replaced with some other member suitable for the purpose. Further, it shall be noted that the figures do not include the necessary measuring scales for the amount and direction of curvature, which may be fixedly secured to the structure.

Above, the invention has been described by way of example with reference to the figures in the accompanying drawing. The invention is, however, not intended to be confined to relating only to the examples illustrated in the figures, but different embodiments of the invention may vary within the scope of the inventive idea defined in the accompanying claims.

What is claimed is:

1. A roll for a web material, comprising an elongate middle part having an outer circumferential surface for engagement with said web material, said middle part having opposite ends, and extending axially from each of said ends an extension of smaller outer diameter than that of said middle part, said extension being adapted to be revolvingly mounted in end bearings, said middle part and extensions being contiguous and operating as a revolving axle of said roll, and end parts pivotal with respect to said middle part to enable the roll to bend each of said end parts being arranged at a respective end of said middle part, and articulation means for articulatably mounting said end parts on said middle part.

2. The roll of claim 1, wherein each of said end parts is tubular and has an axial inner end and an axial outer end, said articulation means being arranged at said axial inner end of each of said end parts, further comprising for each of said end parts a support part arranged in an area of said axial outer end of said end part and on which said end part is revolvingly mounted, said end part being movable in a radial direction on said support part, and a bearing interposed between said support part and said end part.

3. The roll of claim 1, wherein said roll when bent has deflection points where said middle part ends are adjacent said end parts respectively, and said middle part has a larger diameter at an area of deflection points of the roll than at said extension of the roll, said articulation means being arranged at said deflection points to couple said end parts to said middle part.

4. The roll of claim 1, wherein said articulation means are coupled to said middle part at locations at which said middle part is situated within said end parts.

5. The roll of claim 1, wherein said articulation means comprise rubber sleeves.

6. The roll of claim 1, wherein said articulation means comprise an articulation bearing including an outer ring fixed to the inner axial end of said end part and an inner ring fixed to said extension of said middle part, said outer ring and inner ring structured and arranged to pivot with respect to each other without allowing rotational movement with respect to each other around a center axis of the roll.

7. The roll of claim 1, wherein said articulation means constitutes a structural part of the roll itself which has an outer surface contiguous with the outer surface of said middle part and said end parts and which is more flexible than other areas of the roll.

8. The roll of claim 7, wherein said structural part is made of the same material as other structure of the roll.

9. The roll of claim 1, wherein the roll is formed as a shell structure from a composite material.

10. The roll of claim 2, wherein said support parts include a sleeve part having an inside diameter larger than the outer diameter of said extension of said middle part, said bearings of said end parts being arranged on said sleeve parts.

11. A roll for web material, comprising a. an elongate tubular middle part of first outer diameter and having opposite ends, said tubular middle part further comprising a tubular extension extending axially from each of said opposite ends, each of said tubular extensions having outer diameter smaller than said first outer diameter, each of said extensions rotatably mounted in end bearings, whereby said middle part and extensions serve as a rotatable axle for said roll, b. a tubular end part having outer diameter substantially the same as said first outer diameter situated adjacent each of said opposite ends of said tubular middle part and coaxial therewith, and c. articulation means connecting each of said tubular end parts to one of said tubular extensions and to allow articulation of each of said tubular end parts with respect to said tubular middle part.

12. A roll according to claim 11 wherein each of said tubular end parts has an axially spaced inner and outer ends, said inner end of each of said end parts situated adjacent one of said ends of said middle part and coupled thereto by said articulation means, each of said extensions extending axially through one of said outer ends and having radial clearance with said extension.

13. A roll according to claim 11 wherein each of said extensions has an outer diameter less than that of said middle part, said articulation means couples said inner end of each of said end parts to one of said extensions.

14. A roll according to claim 13 wherein said articulation means is flexible, and wherein rotation of said middle part and extensions coupled to said end parts causes rotation of said end parts.

* * * * *